US006932058B2

(12) United States Patent
Nickel et al.

(10) Patent No.: US 6,932,058 B2
(45) Date of Patent: Aug. 23, 2005

(54) CARBURETOR ARRANGEMENT FOR AN INTERNAL COMBUSTION ENGINE

(75) Inventors: Hans Nickel, Cottenweiler (DE); Claus Naegele, Stuttgart (DE)

(73) Assignee: Andreas Stihl AG & Co. KG (DE)

( * ) Notice: Subject to any disclaimer, the term of this patent is extended or adjusted under 35 U.S.C. 154(b) by 0 days.

(21) Appl. No.: 10/896,213

(22) Filed: Jul. 21, 2004

(65) Prior Publication Data

US 2005/0022790 A1 Feb. 3, 2005

(30) Foreign Application Priority Data

Aug. 1, 2003 (DE) ..... 103 35 345

(51) Int. Cl.[7] ..... F02M 1/08
(52) U.S. Cl. ..... 123/438; 123/179.18; 123/491
(58) Field of Search ..... 123/438–439, 123/179.14, 179.16, 179.18, 179.7, 179.3

(56) References Cited

U.S. PATENT DOCUMENTS 5,031,593 A * 7/1991 Erhard et al. ..... 123/331
5,794,593 A * 8/1998 Sugii ..... 123/438
6,354,571 B1 * 3/2002 Gerhardy ..... 261/35
6,505,616 B2 * 1/2003 Hehnke ..... 123/588
6,672,289 B2 * 1/2004 Gau ..... 123/514
6,679,211 B2 * 1/2004 Nickel ..... 123/179.14
6,755,395 B2 * 6/2004 Nickel ..... 261/23.2

* cited by examiner

*Primary Examiner*—Hai Huynh
(74) *Attorney, Agent, or Firm*—Robert W Becker & Associates; Robert W Becker

(57) ABSTRACT

A carburetor arrangement is provided for an internal combustion engine that is to be started with a pull cord. A fuel channel that is connected with a fuel-filled storage space opens into and supplies fuel to an intake channel portion as a function of the underpressure in the intake channel portion. The underpressure in the intake channel portion is increased during the start-up process via a start-up mechanism. To keep the engine ready to run with the start-up mechanism engaged, a control valve is disposed between the storage space and where the fuel channel opens into the intake channel portion. The control valve is opened or closed by a control unit as a function of the speed of the internal combustion engine.

9 Claims, 2 Drawing Sheets time
time
time
$F_o$
F
$F_u$
$D_{max}$
$D_{min}$
$D_{max}$
$D_{min}$
D
C
B
A
G
$t_1$
$t_2$
$t_3$
$t_4$
$t_5$
$t_6$
$t_7$
8000
6000
4000
2000
open
closed
rich
lean

CARBURETOR ARRANGEMENT FOR AN INTERNAL COMBUSTION ENGINE

BACKGROUND OF THE INVENTION

The present invention relates to a carburetor arrangement for an internal combustion engine, especially for an internal combustion engine in a manually-guided implement such as a power chain saw, a brush cutter, a cut-off machine, or the like, which engine is to be started by a pull-cord.

Carburetor arrangements for two-cycle engines, for manually-guided implements, and that are to be started via a pull cord, are known in general. Opening into the intake channel portion is a fuel channel that is connected with a fuel-filled storage space and that supplies fuel as a function of the underpressure in the intake channel. Since internal combustion engines that are to be started by a pull cord achieve only low starting speeds, for the start-up via a start-up mechanism the intake underpressure is increased in that for example a choke valve reduces the flow cross-section of the intake channel portion upstream of the carburetor arrangement. This ensures that even with a pull cord starter, adequate fuel is drawn in during the start-up process, so that a mixture that is capable of being ignited is made available with few starting strokes, and ensures a start-up of the internal combustion engine.

The drawback of such start-up mechanisms that increase the intake underpressure is that they are also operational as the internal combustion engine starts up, so that the accelerating internal combustion engine leads to a sharp increase of the intake underpressure and hence to an increased supply of fuel, as a result of which the mixture becomes very rich. As a result, the mixture becomes overly rich as the internal combustion engine accelerates, and the engine dies. As the internal combustion engine starts up, the operator must therefore open the choke in a timely manner and at the same time must see to it that during the warm-up phase, the mixture does not become lean, by complete opening of the choke to such an extent that the engine dies.

It is therefore an object of the present invention to provide a carburetor arrangement such that with the choke engaged and the internal combustion engine accelerating, a dying of the engine due to an overly rich mixture is reliably prevented.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
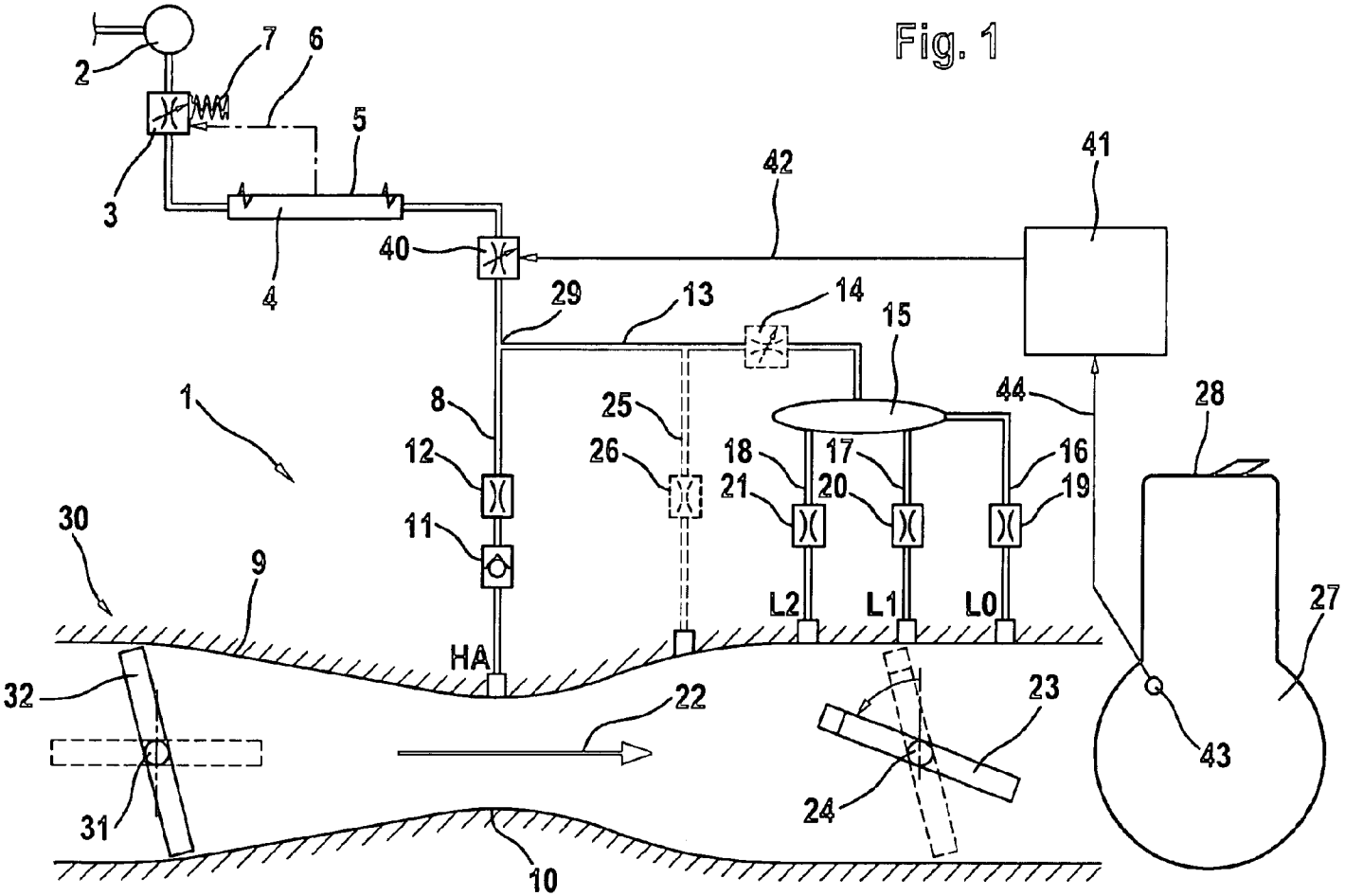
FIG. 1 shows one exemplary embodiment of the inventive carburetor arrangement having an electromagnetically actuatable valve.

A control valve is disposed in the fuel channel ahead of where the latter opens into the intake channel portion. The control valve is actuated by a control unit as a function of at least one operating parameter of the internal combustion engine; pursuant to one preferred embodiment of the invention, this parameter can be the speed of the internal combustion engine. By means of the control unit, for example after exceeding a first threshold speed, the control valve is closed, thus achieving a leaner mixture in conjunction with a sharp increase in speed. The control valve remains closed, so that the mixture becomes even leaner, and after exceeding a maximum speed the speed drops off. In the vicinity of the maximum speed, the fuel supply is again opened, so that the mixture again becomes richer and the drop in speed is checked. In the vicinity of a following minimum speed, the control valve, and hence the fuel supply, are again shut off, so that in the following time interval the speed again increases due to the thereby established leaner mixture. This cycle is repeatedly carried out, so that despite the closed choke the speed of the internal combustion engine can be held in a speed band that is operationally stable. The engine remains able to run, and does not die. The operator has sufficient time to partially or entirely throttle back the choke out of the start-up position in order to keep the internal combustion engine operationally ready. In addition to an open/closed operation of the valve, the latter can also be cycled such that every desired passage quantity can be proportionally established. The supply of fuel can thus be established such that it is adapted to the speed.

To recognize the maximum and the minimum of the speed curve, the speed gradient can advantageously also be used as the operating parameter according to which the carburetor arrangement is to be controlled. If the gradient becomes zero, an extreme value is present.

If a plurality of fuel channels open into the intake channel portion, it can be advantageous to branch the channels off from a channel branching, and to dispose the control valve upstream of the channel branching as viewed in the direction of flow of the fuel. In this way, it is possible with only a single control valve to control all of the fuel channels that open into the intake channel portion. It can also be expedient to control only one or a selected few of the channels via the control valve. This can be easily achieved by an appropriate design of the channel branchings.

Further specific features of the present application will be described in detail subsequently.

DESCRIPTION OF SPECIFIC EMBODIMENTS

Referring now to the drawings in detail, the carburetor arrangement 1 is supplied via a fuel pump 2 from a fuel supply that is not illustrated in detail. The fuel pump 2 conveys fuel via an inlet valve 3 into a storage space, which in the illustrated embodiment is in the form of a regulating chamber 4. The regulating chamber 4 is delimited by a control diaphragm 5 that via a mechanical lever connection 6 opens the inlet valve 3 against the force of a spring 7.

By means of a fuel channel 8, fuel flows into an intake channel portion 9 in which a venturi section 10 is advantageously formed. The fuel channel 8 opens via a main discharge HA into the intake channel 9, expediently in the region of the venturi section 10. Disposed in the fuel channel 8, upstream of the main discharge HA, as viewed in the direction of flow are a check valve 11 as well as a throttle or flow control device 12.

Branching off from the fuel channel 8, which in the illustrated embodiment forms the main nozzle path, is a further fuel channel 13 that, via an idling adjusting screw 14, leads into an idling chamber 15. Branching off from the idling chamber 15 are idling nozzle paths 16, 17 and 18 that respectively open into the intake channel portion 9 via a throttle or flow control device 19, 20, and 21. In this connection as viewed in the direction of flow 22 of the air for combustion, the openings of outlets L0, L1, L2 are successively disposed in the region of a butterfly valve 23 that is mounted in the intake channel portion 9 so as to be rotatable about a butterfly valve shaft 24. In the closed position of the butterfly valve 23, the outlet L0 of the idling nozzle path 16 is disposed downstream of the butterfly valve 32, while the outlet L1 of the idling nozzle path 17 is disposed approximately in the region of the closed butterfly valve. The outlet L2 of the idling path 18 is disposed upstream of the butterfly valve 23 when the latter is closed.

It can be expedient to dispose a partial throttle fixed nozzle between the outlet of the main nozzle discharge HA in the region of the venturi section 10, and the butterfly valve 23 that is disposed after the venturi section in the direction of flow 22. For this purpose, a fuel channel 25 is provided that is indicated by dashed lines and that opens into the intake channel portion 9 via a throttle or flow control device 26 downstream of the venturi section 10 between the discharge HA and the outlet L2.

Provided upstream of the venturi section 10 is a start-up mechanism 30 that comprises a choke valve 32 that is rotatable about a shaft 31. The choke valve 32 is indicated by dashed lines in the open position; for a start-up, the choke valve is closed, so that it is disposed in the position indicated by solid lines.

The intake channel portion 9 opens, for example into the crankcase 27 of a two-cycle engine 28, which is illustrated merely schematically, Instead of the two-cycle engine, some other type of internal combustion engine 28 can also be provided, for example a mixture-lubricated four-cycle engine, a scavenging engine, or the like.

Pursuant to the invention, a control valve 40 is disposed in the fuel channel 8 between the storage space, which is embodied as the regulating chamber 4, and the opening or discharge HA of the fuel channel 8 into the intake channel portion 9; the control valve 40 shuts off, or at least throttles, the flow of fuel in the fuel channel 8. In the illustrated embodiment, the preferably electromagnetically activated control valve 40 is provided in the channel portion between the storage space 4 and a channel branching 29 of the fuel channel 8, so that via the control valve 40 all of the fuel channels that are connected to the channel branching 29 can be controlled. In the illustrated embodiment, it is possible to control via the control valve 40 not only the main fuel channel 8 to the discharge HA, the fuel channel 25 for partial load, the fuel channel 13 to the idling chamber 15, and hence also the idling paths 16, 17 and 18.

The control valve 40 is actuated by a control unit 41 that is connected with the control valve 40 via an appropriate control line 42, in the illustrated embodiment an electrical line. By means of a sensor 43 and a signal line 44, the control unit 41 receives operating parameters of the internal combustion engine 28, for example the speed of the engine. The control unit 41 can process one or even several operating parameters of the internal combustion engine in order to effect an inventive actuation of the control valve 40.

Pursuant to the invention, the control valve 40 is provided in order, after the start-up of the internal combustion engine, and with the choke valve 32 closed (solid lines), to prevent a dying of the internal combustion engine due to an overly rich fuel/air mixture drawn in via the intake channel portion 9.

Figures 2, 3, 4:
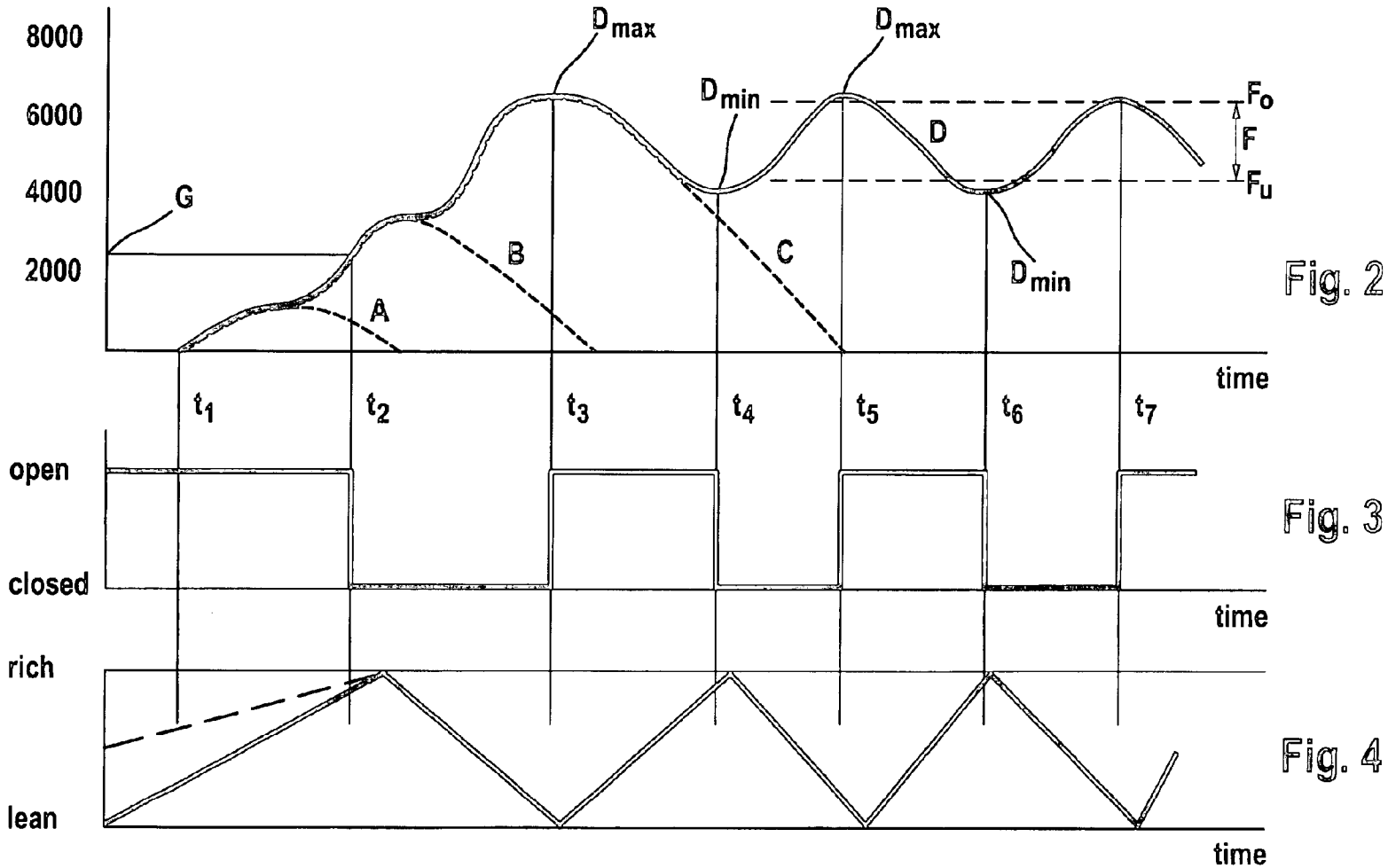
FIG. 2 shows a graph in which an assumed speed course during start-up is plotted versus time.
FIG. 3 is a graph showing the state of control of the electromagnetic valve versus time.
FIG. 4 shows a graph showing the mixture state of a fuel/air mixture in the intake channel versus time.

As FIG. 2 shows, at a point in time $t_1$, the control valve 40 is open (FIG. 3); during start-up of the internal combustion engine, a correspondingly rich mixture is established.

The internal combustion engine is, in particular, an engine that is started via a pull cord starter. The curve A in FIG. 2 shows a first, unsuccessful start-up attempt. An attempt to start the engine is made at the point in time $t_1$, whereby the control valve is open and the mixture can become richer, in conformity with FIG. 4. Due to a failed ignition, the speed follows the curve A in FIG. 2.

If the engine starts, due to the increasing intake underpressure in the intake channel portion 9, with the choke 32 closed, a considerable quantity of fuel enters into the channel, which leads to a very rich mixture. Therefore, pursuant to FIG. 3, when the threshold speed G is exceeded at the ignition time point t2, the control valve 40 is closed so that, accompanied by an appropriate time delay, the mixture becomes leaner. The leaner mixture leads to an increasing speed, whereby approximately at the point in time $t_3$ a maximum speed $D_{max}$ is achieved, after which due to the mixture becoming too lean, the speed again begins to drop.

The control unit 41 recognizes the maximum speed $D_{max}$, for example by monitoring and comparing the actual speed at the start and end of a prescribed time interval and/or by monitoring the speed gradients, and after an ascertained maximum speed $D_{max}$ effects an opening of the control valve 40. At the point in time $t_3$ the control valve 40 opens and again releases the flow of fuel into the fuel channels with the result that due to the high intake channel underpressure, with the choke valve 32 continuing to be closed, an increased quantity of fuel enters the intake channel portion 9, and the mixture again becomes richer.

The drop in speed is checked, and at the point in time $t_4$ a minimum speed $D_{min}$ is passed through, which the control unit 41 recognizes and in response again closes the control valve 40 (FIG. 3). After the point in time L4, the rich mixture again becomes leaner (FIG. 4), so that as a consequence of the leaner mixture the speed again increases until the next maximum speed $D_{max}$ is reached and the control valve 40 is again opened. This cycle is continuously repeated, so that despite a closed choke valve 32, the internal combustion engine remains able to run, and at a given time the user can manually throttle back the choke. A dying of the internal combustion engine due to an over rich mixture is prevented. The idling speed can be held in an acceptable band width F, whereby the fluctuations in speed in the idling range are about 2000 rpm; the engine remains able to run.

Instead of monitoring the maximum speed Dmax and the minimum speed Dmin, and the respective activation and deactivation of the fuel supply by actuating the control valve 40, the control unit 41 can, in principle, undertake control of the control valve 40 by monitoring the speed limits $F_u$ and $F_o$ of the speed band F. In such an embodiment, after successful start-up of the internal combustion engine, and an exceeding of a threshold speed G, first the control valve 40 is closed, due to which the speed can increase above an upper threshold speed $F_o$ of the speed band F. After the upper threshold speed $F_o$ has been exceeded, the valve 40 is opened, so that due to the thereby resulting enrichment the increase in speed is checked and the speed again drops. After dropping below the lower limit $F_u$ of the speed band F, the control valve 40 is again closed, so that the thereby established leaner mixture leads to a new increase of the speed.

Without the inventive activation and deactivation of the fuel supply, after a successful start-up of the internal combustion engine, and increasing speed, the mixture would become very rich and then pursuant to the indicated curve B the engine would die. This can be prevented only if after the start-up of the internal combustion engine the choke valve is rapidly manually blocked into an at least partially opened position. Due to the inventive periodic blocking of the fuel supply, with the choke closed leaner mixture is brought about, so that despite a closed choke the internal combustion engine remains able to run.

The specification incorporates by reference the disclosure of German priority document 103 35 345.3 filed Aug. 1, 2003.

The present invention is, of course, in no way restricted to the specific disclosure of the specification and drawings, but also encompasses any modifications within the scope of the appended claims.

We claim:

1. A carburetor arrangement for an internal combustion engine, comprising:

an intake channel portion;

a fuel channel that opens into said intake channel portion, wherein said fuel channel is connected to a fuel-filled storage space and supplies fuel to said intake channel portion as a function of an underpressure in said intake channel portion;

a start-up mechanism for increasing the underpressure in said intake channel portion during a start-up process;

a control valve disposed in said fuel channel between said storage space and where said fuel channel opens into said intake channel portion; and a control unit connected to said control valve, wherein said control unit controls said control valve as a function of at least one operating parameter of said internal combustion engine.

2. A carburetor arrangement according to claim 1, wherein said internal combustion engine is an internal combustion engine that is to be started by a pull-cord.

3. A carburetor arrangement according to claim 1, wherein said at least one operating parameter is the speed of said internal combustion engine.

4. A carburetor arrangement according to claim 1, wherein after a threshold speed of said control valve is exceeded, said control valve is closed by said control unit, and wherein approximately after a following maximum speed is reached, said control valve is opened by said control unit and is closed thereby upon reaching a following minimum speed.

5. A carburetor arrangement according to claim 1, wherein a speed gradient of a speed curve is used as said at least one operating parameter of said internal combustion engine.

6. A carburetor arrangement according to claim 1, wherein a plurality of fuel channels open into said intake channel portion, and wherein some of said fuel channels are controlled in common by said control valve.

7. A carburetor arrangement according to claim 6, wherein all of said fuel channels are controlled in common by said control valve.

8. A carburetor arrangement according to clam 1, wherein said start-up mechanism comprises a choke valve.

9. A carburetor arrangement according to claim 8, wherein said choke valve is disposed in said intake channel portion.

* * * * *